US008931112B1

(12) United States Patent
Furst et al.

(10) Patent No.: US 8,931,112 B1
(45) Date of Patent: Jan. 13, 2015

(54) PROTECTIVE SHELL RECEPTIVE FOR GRAPHICS

(71) Applicant: Pain Killer Products, LLC, Phoenix, AZ (US)

(72) Inventors: Christopher Furst, Tempe, AZ (US); Michael John Furst, Tempe, AZ (US); Eric Scott Knight, Phoenix, AZ (US)

(73) Assignee: Pain Killer Products, LLC, Phoenix, AZ (US)

( * ) Notice: Subject to any disclaimer, the term of this patent is extended or adjusted under 35 U.S.C. 154(b) by 54 days.

(21) Appl. No.: 13/694,181

(22) Filed: Nov. 2, 2012

(51) Int. Cl.
*A41D 13/06* (2006.01)
*A41D 27/00* (2006.01)

(52) U.S. Cl.
CPC ..... *A41D 13/065* (2013.01)
USPC ..... 2/24; 2/22; 2/267

(58) Field of Classification Search
CPC ..... A63B 71/1225; A63B 2071/1258; A63B 2071/1283; A63B 2071/125; A63B 2243/0004; A63B 2071/1266; A63B 2243/0041; A41D 13/06; A41D 13/0543; Y10S 2/911; B32B 2305/18; B32B 2307/412; B32B 2307/414; B32B 2307/584; B32B 2369/00; B32B 2451/00; B32B 37/185; B32B 27/365; B32B 2425/00; B32B 17/1055; B32B 2307/40; B32B 2605/006; B32B 17/10752; B32B 17/1088; B32B 2519/00; B32B 37/1292; B32B 38/145; B32B 38/1866; C08J 2369/00; B42D 15/10; B42D 2033/30; B42D 2037/08; B44C 5/04; B44C 5/005; B44C 3/02; B44C 5/0446; B29L 2009/00
See application file for complete search history.

(56) References Cited

U.S. PATENT DOCUMENTS

| | | | | | |
|---|---|---|---|---|---|
| 2,726,941 | A | * | 12/1955 | Markus et al. | 428/164 |
| 2,729,009 | A | * | 1/1956 | Markus et al. | 428/43 |
| 2,729,010 | A | * | 1/1956 | Markus et al. | 428/43 |
| 2,810,978 | A | * | 10/1957 | Chapman | 40/310 |
| 2,867,053 | A | * | 1/1959 | Boor | 312/31 |
| 2,926,439 | A | * | 3/1960 | Holick | 40/1.5 |
| 3,055,133 | A | * | 9/1962 | Anderson | 40/586 |
| 3,205,118 | A | * | 9/1965 | Guffan | 160/238 |
| 3,386,199 | A | * | 6/1968 | Nagatsuka | 40/772 |
| 3,494,056 | A | * | 2/1970 | Elzer | 40/594 |
| 3,705,935 | A | * | 12/1972 | Francis | 64/257 |
| 3,997,991 | A | * | 12/1976 | Hayman-Chaffey et al. | 40/361 |
| 4,100,010 | A | * | 7/1978 | Waugh | 156/242 |
| 4,197,151 | A | * | 4/1980 | Muzik | 156/249 |
| 4,234,640 | A | * | 11/1980 | Wittel | 428/159 |
| 4,292,827 | A | * | 10/1981 | Waugh | 72/46 |
| 4,310,976 | A | * | 1/1982 | Wilten | 40/737 |
| 4,329,409 | A | * | 5/1982 | Wreede et al. | 430/1 |

(Continued)

*Primary Examiner* — Bobby Muromoto, Jr.
(74) *Attorney, Agent, or Firm* — Robert D. Atkins; Patent Law Group: Atkins and Associates, P.C.

(57) ABSTRACT

A protective shell has a proper size, shape, and thickness to cover and attach to an anatomical joint or part. The protective shell is made of a material that is rigid, and that is partially or entirely transparent or semitransparent. The protective shell has an exterior face and an interior face, allowing for the application of graphics to be placed upon the interior face while viewing the graphics from the exterior face and protecting the graphic from being scraped off as a result of friction from a ground surface or with a collision from another object. The frontal external face is concave in shape to be less exposed to the ground plane and being scraped than the rest of the external faces of the shell while allowing the graphic that is placed upon the interior face to be viewed more clearly from the front of the exterior face.

22 Claims, 8 Drawing Sheets

(56) References Cited

U.S. PATENT DOCUMENTS

| | | | | | |
|---|---|---|---|---|---|
| 4,332,074 | A | * | 6/1982 | Auld et al. | 29/527.4 |
| 4,356,617 | A | * | 11/1982 | Coscia | 29/527.4 |
| 4,481,160 | A | * | 11/1984 | Bree | 264/135 |
| 4,500,374 | A | * | 2/1985 | Nakazima | 156/83 |
| 4,556,588 | A | * | 12/1985 | Rockwood | 428/13 |
| 4,570,269 | A | * | 2/1986 | Berlese | 2/16 |
| 4,581,271 | A | * | 4/1986 | Gordon | 428/67 |
| 4,585,684 | A | * | 4/1986 | Mackarous | 428/79 |
| 4,605,575 | A | * | 8/1986 | Auld et al. | 428/14 |
| 4,613,128 | A | * | 9/1986 | Lasky | 40/489 |
| 4,716,672 | A | * | 1/1988 | Arakawa | 40/615 |
| 4,758,296 | A | * | 7/1988 | McGrew | 156/231 |
| 4,801,479 | A | * | 1/1989 | Fielder et al. | 428/31 |
| 4,815,149 | A | * | 3/1989 | Erhardt et al. | 2/403 |
| 4,837,864 | A | * | 6/1989 | Thill | 2/244 |
| 4,838,965 | A | * | 6/1989 | Bussard | 156/83 |
| 4,852,276 | A | * | 8/1989 | Savoca et al. | 36/136 |
| 4,913,504 | A | * | 4/1990 | Gallagher | 359/1 |
| 4,921,319 | A | * | 5/1990 | Mallik | 359/1 |
| 4,923,848 | A | * | 5/1990 | Akada et al. | 503/227 |
| 4,924,613 | A | * | 5/1990 | Levin | 40/586 |
| 4,933,218 | A | * | 6/1990 | Longobardi | 428/38 |
| 4,956,040 | A | * | 9/1990 | Fry | 156/267 |
| 5,005,219 | A | * | 4/1991 | Diaz | 2/244 |
| 5,009,943 | A | * | 4/1991 | Stahl | 428/40.6 |
| 5,010,672 | A | * | 4/1991 | Coleman | 40/615 |
| 5,048,123 | A | * | 9/1991 | Monson | 2/69 |
| 5,073,222 | A | * | 12/1991 | Fry | 156/267 |
| 5,082,703 | A | * | 1/1992 | Longobardi | 428/38 |
| 5,173,968 | A | * | 12/1992 | Fox | 2/244 |
| 5,209,000 | A | * | 5/1993 | Rowland et al. | 36/136 |
| 5,255,391 | A | | 10/1993 | Levine | |
| 5,281,499 | A | * | 1/1994 | Bussard | 430/1 |
| 5,314,767 | A | * | 5/1994 | Bussard | 430/1 |
| 5,455,129 | A | * | 10/1995 | Bussard | 430/1 |
| 5,598,582 | A | * | 2/1997 | Andrews et al. | 2/16 |
| 5,636,385 | A | * | 6/1997 | Harrison | 2/244 |
| 5,920,915 | A | * | 7/1999 | Bainbridge et al. | 2/456 |
| 5,933,867 | A | * | 8/1999 | Corder | 2/160 |
| 5,987,643 | A | | 11/1999 | Beutler | |
| 6,050,539 | A | * | 4/2000 | Millen | 248/678 |
| 6,408,442 | B1 | * | 6/2002 | Kang | 2/167 |
| 6,560,781 | B1 | * | 5/2003 | Keene et al. | 2/22 |
| 6,618,860 | B1 | * | 9/2003 | Sullivan et al. | 2/159 |
| 6,625,815 | B2 | * | 9/2003 | Litke | 2/161.2 |
| 6,729,058 | B2 | * | 5/2004 | Ferguson | 40/636 |
| 7,254,840 | B2 | * | 8/2007 | Hammons et al. | 2/16 |
| 7,438,407 | B2 | * | 10/2008 | Coghlan et al. | 347/105 |
| 7,691,470 | B2 | * | 4/2010 | Goodson et al. | 428/212 |
| 7,794,896 | B2 | * | 9/2010 | Erben et al. | 430/1 |
| D626,293 | S | | 10/2010 | Pacetti | |
| 8,453,348 | B2 | * | 6/2013 | Fox et al. | 36/44 |
| 8,458,932 | B2 | * | 6/2013 | Schnuckle | 40/306 |
| 8,464,363 | B2 | * | 6/2013 | Halverson et al. | 2/159 |
| 2002/0139009 | A1 | * | 10/2002 | Mark | 36/54 |
| 2002/0192452 | A1 | * | 12/2002 | Harrison et al. | 428/304.4 |
| 2003/0003198 | A1 | * | 1/2003 | Scalise | 426/106 |
| 2003/0188373 | A1 | * | 10/2003 | Garneau | 2/161.1 |
| 2004/0208959 | A1 | * | 10/2004 | Scalise | 426/106 |
| 2005/0083676 | A1 | * | 4/2005 | VanderSchuit | 362/84 |
| 2006/0027292 | A1 | * | 2/2006 | Persic | 150/105 |
| 2007/0039682 | A1 | * | 2/2007 | Drake et al. | 156/230 |
| 2008/0002068 | A1 | * | 1/2008 | Knight et al. | 348/789 |
| 2012/0233746 | A1 | * | 9/2012 | Jwa | 2/414 |
| 2013/0025031 | A1 | * | 1/2013 | Laperriere et al. | 2/414 |
| 2013/0236643 | A1 | * | 9/2013 | Coghlan et al. | 427/258 |

* cited by examiner

PROTECTIVE SHELL RECEPTIVE FOR GRAPHICS

BACKGROUND OF THE INVENTION

Today's protective knee pads are built and designed to provide excellent protection for high impact falls and collisions that a user might subject them to. In events such as roller derby, skateboarding, inline skating and motocross, just to name a few.

A knee pad usually includes, but is of limited to, an irregularly shaped piece or multiple pieces of padded material, such as foam, that are molded and folded to form around the contours of the knee to provide protection with a degree of flexibility.

This padding is usually covered with a durable fabric. Attachment systems that secure the pad to the knee vary. Common ones are straps that wrap around the thigh and calf and also flexible sleeves in which the leg can slide into.

One major component of today's protective knee pads is its exterior cap, shield, or shell, that is comprised of a rigid material and covers its front face to act as the first line of defense with a collision to the ground or into another object, shielding its wearer of injury and the pad from the abrasion of the ground surface.

Originally, knee pads were created with protection in mind. This also applied to their protective shells which have continued to their present designs. Unrecognized within prior art is that the shells are limited in their ability to contain art, images, or graphics on them.

Shells in the patents of U.S. Pat. No. 5,255,391 to Levine, 1993 Oct. 26 and U.S. Pat. No. 5,987,643 to Beutler, 1999 Nov. 23 show a basic opaque shell with no specification toward transparency or a shape receptive for graphics to be applied on the interior or exterior of them.

9626,293 to Pacetti, 2010 Oct. 26 show a shell with an attachment system using hook and loop fasteners that is contiguous between the interior of the shell and the cloth covering. This type of attachment system has been used extensively within the field and Pacetti's embodiment is a slight variation upon that method. Pacetti's embodiment uses hook and loop on the interior of the shell that would otherwise cover and or block any attempt to place graphics on the underside of the shell if that shell were to be transparent or semitransparent to show graphics from the underside or interior of the shell.

Again, as in the previous aforementioned patents, no specific examples of shape, transparency or attachment systems have been mentioned with regard to the shell's receptivity toward graphics.

Shells that have been previously mentioned in the introduction have been exhibited as an element of protective knee pads. This has been done for illustrative purposes only. The embodiment of the shells that have been mentioned and any further examples may apply but are not limited to other areas of protective gear such as the protective shells on elbow pads, the shells contained on motorcycle jackets, the shells contained on bmx (bicycle motocross) protective gear, or the shells on a baseball catcher's leg gear; just to name a few.

All protective shells on protective gear heretofore known suffer from these disadvantages in regard toward applying graphics to them. The protective shells are made with materials that are solid, opaque colors. Due to this fact, graphics and or text have to be placed on the exterior of the shell, the face that is farthest away from the joint, to be seen, leaving the graphics and or text exposed to be scraped off when the shells slide against the ground during a fall or collision of the user. This also leaves the unwanted affect of paint, glue and or residue from the graphics as a result of being scraped off of the shell and onto a surface such as a wooden floor of a roller rink, as an example. Shells have been rounded in shape to conform to its underlying protection such as foam that protects the knee, as an example, but a specific shell shape has not been developed to protect graphics from being scraped off the shell as a result of friction from the shell onto the ground or into another object. Many shell attachment systems, such as hook and loop, that are on the interior side of the shell, or the contiguous face closest to the joint, block or eliminate a space that otherwise could be used for the application of graphics. A shell made with a transparent or semi-transparent material has not been created for protective gear to implement the placement of graphics on the face of the shell that is contiguous or closest to the joint. In other words, its interior or underside.

SUMMARY OF THE INVENTION

The present embodiment relates to a protective shell that is visible, rigid, transparent or semitransparent in material, with sufficient size, shape and thickness to cover, conform, and attach around the protective material above an anatomical joint or part, such as but not limited to, a knee or elbow and on such items as, but not limited to, a protective knee pad or elbow pad. The shell's material being partially or entirely transparent or partially or entirely semitransparent, allowing for the reception of graphics to be placed upon the interior face, the side closest to the joint, of the shell. Thus, allowing the graphic to be viewed through the shell from its exterior face while being protected from the friction of a ground surface or collision with another object. In a preferred embodiment, using but not limited to, a partially or entirely transparent shell or a partially or entirely semitransparent shell; having its front, central, exterior face slightly concave in shape to create a slight depression around the graphic, enabling this area to be less exposed than the rest of the shell to a ground surface when friction occurs. Other variations on the shell include its size, shape and thickness. Attachment systems may vary dependent upon the item that the shell is being attached to and may be removable or non-removable from that item.

Accordingly, several advantages of one or more aspects are as follows: to provide for the reception of graphics onto the interior face of the shell so as to be seen from the shell's exterior face; to allow for the protection of the graphic from friction with ground surfaces or collision with other objects; to eliminate the marring of a ground surface, such as a wooden roller track, from the paint and residue of graphics that have been applied to the exterior face of a shell; to reduce the chance of marring the ground surface from the friction of the cap itself, a transparent or semi-transparent shell leaving much less of a trace than a colored, opaque shell.

BRIEF DESCRIPTION OF THE DRAWINGS

While the specification concludes with claims particularly pointing out and distinctly claiming that which is regarded as the present embodiment, the advantages of this embodiment can be more readily ascertained from the following description of the invention when read in conjunction with the accompanying drawings. The components in the figures are not necessarily to scale. Size, shape, thickness and placement may vary. The emphasis instead being placed upon illustrating the principles of the invention.

DETAILED DESCRIPTION OF THE DRAWINGS

Referring to FIG. 1-4, a protective knee pad 14 is shown for illustrative purposes.

Figure 1:
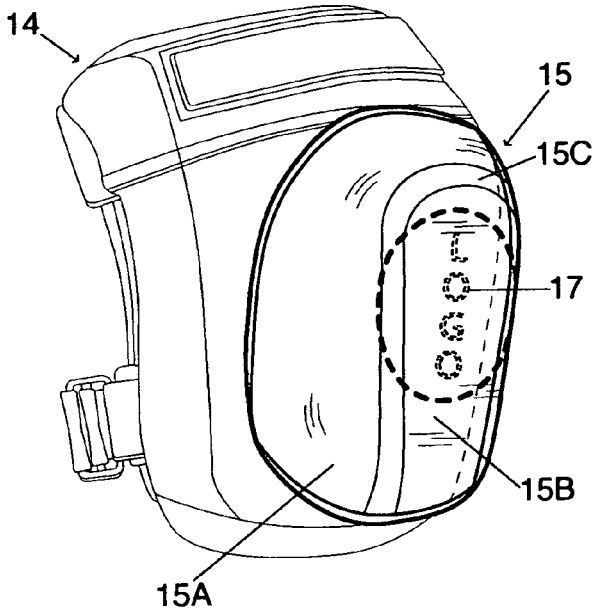
FIG. 1 shows a perspective view of a protective knee pad with, a transparent shell that has a graphic applied to its interior face; the shell being attached to the protective knee pad, in accordance with one embodiment.

Referring to FIG. 1 a protective transparent shell 15 is shown attached to knee pad 14. A thin dashed line is drawn on pad 14 to delineate its periphery outline. Shell 15 is comprised of a convex exterior face 15A, a concave exterior face 15B, a buffer zone transitional area from exterior concave face to exterior convex face 15C, an interior concave face 16 (shown in FIG. 2), and a graphic 17. Shell 15 is transparent with the exception of graphic 17 which is opaque in color. At present, polycarbonate is contemplated for shell 15, but other materials are suitable. In FIGS. 1, 2, 5, and 6, Graphic 17 is drawn with dashed lines to represent its placement on the shell's interior concave face 16 which cannot be drawn in FIG. 1 because shell 15 sits on top of pad 14. Shown in FIG. 2, Interior face 16 lies opposite of: convex exterior face 15A, concave exterior face 15B, exterior buffer zone 15C. In FIGS. 1, 2, 5, 6, 8 Graphic 17 has the wording "logo" on it. This is for illustrative purposes only and may be of any shape, size, color, or variation graphically that is suitable to be placed upon interior face 16.

Figure 2:
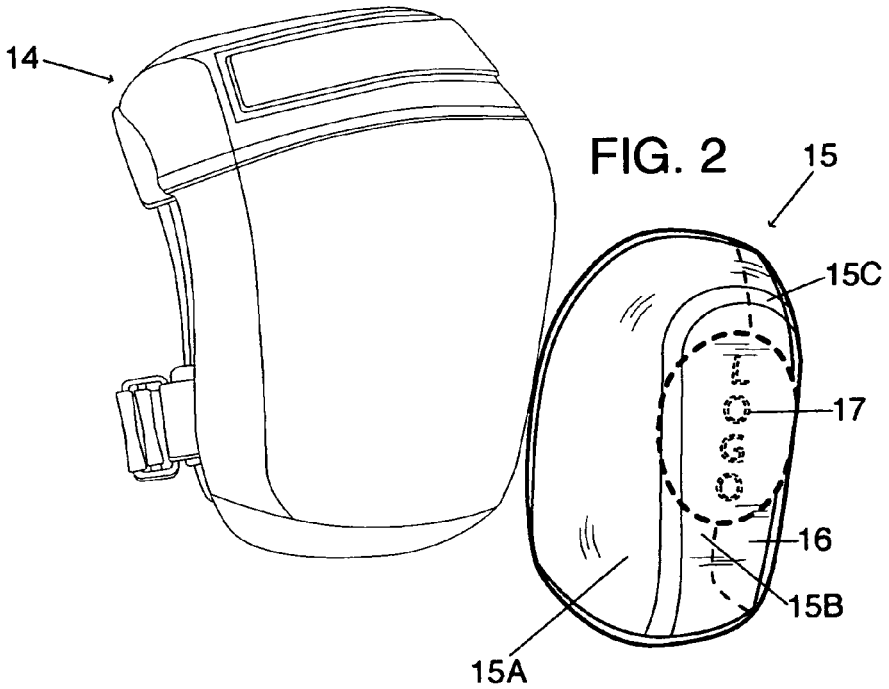
FIG. 2 shows an exploded perspective view of a protective knee pad with, a transparent shell that has a graphic applied to its interior face; the shell is detached from the knee pad, in accordance with one embodiment.

Referring to FIG. 2 shows shell 15 detached from pad 14. From this view the interior face 16 is shown as the shell 15 curves around its far side. The vertical dashed lines represent the periphery of shell 15 as it curves around. They also show an area of the interior face 16.

Referring to FIG. 1 and FIG. 2, shell 15 shows the convex exterior face 15A rounding into the concave exterior face 15B. Buffer zone 15C shows where convex exterior face 15A transitions into concave exterior face 15B. Concave exterior face 15B, provides protection from scraping against a ground surface because it is less exposed due to its shape when shell 15 slides along a ground surface. The brunt of friction and thus scratching being in the area of the buffer zone 15C. This shape is advantageous because it provides a clearer viewing area with less scratching in the area where graphic 17 would be viewed. The shape of shell 15 along with the shapes of: convex exterior face 15A, concave exterior face 15B, and buffer zone 15C, and interior face 16, may vary. The emphasis instead being placed upon illustrating the principles of the embodiment.

Figure 3:
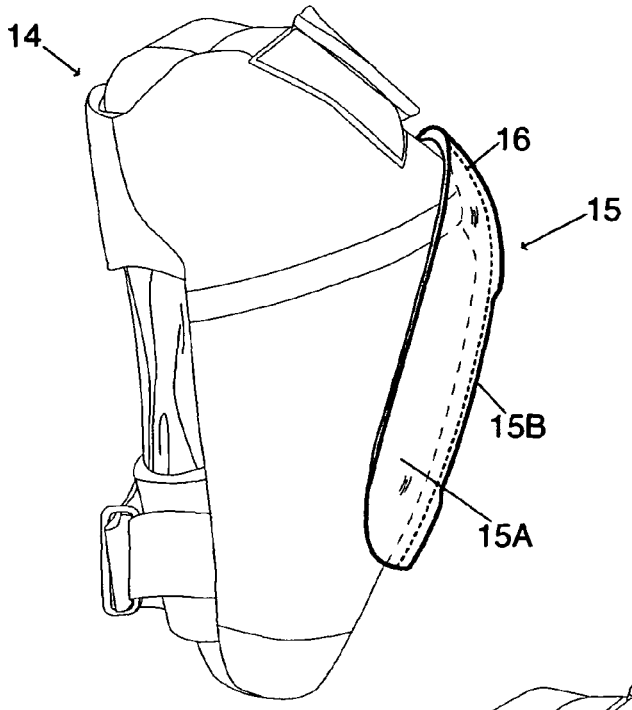
FIG. 3 shows a side view of a protective knee pad with, a transparent shell that has a graphic applied to its interior face; the shell being attached to the kneepad, in accordance with one embodiment.

Referring to FIG. 3, shows how shell 15 conforms in shape to pad 14. There are many variations to the shape of shell 15 that can conform to its underlying elements, dependent upon the type of protective gear it is used for. The thin dashed lines in pad 14 represent its periphery being contiguous with interior face 16, which is represented with a thicker dashed line. Graphic 17 is not able to be seen from this viewpoint. This view provides a clear outline of the convex exterior face 15A transitioning into concave exterior face 15B.

Figure 4:
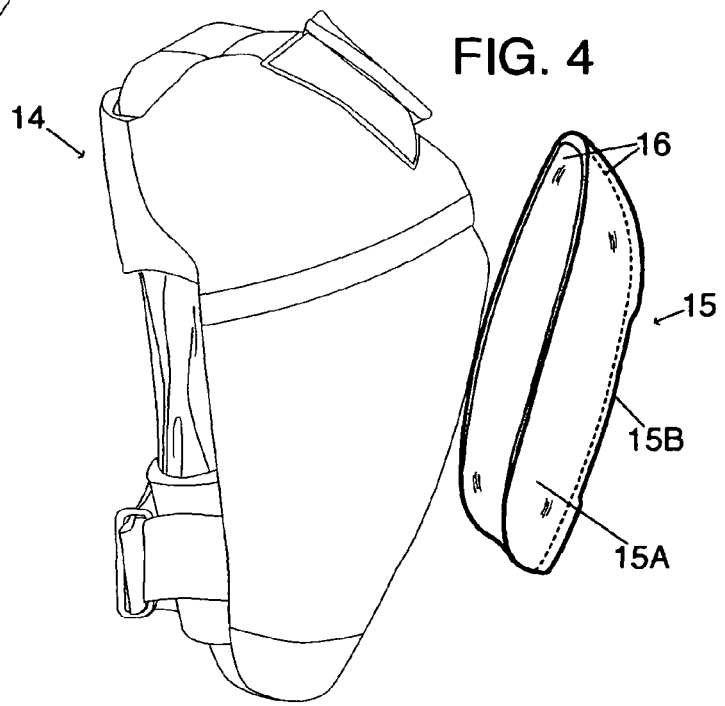
FIG. 4 shows an exploded side view of a protective knee pad with, a transparent shell that has a graphic applied to its interior face; the shell is detached from the knee pad, in accordance with one embodiment.

Referring to FIG. 4, shows shell 15 detached from pad 14. This view gives a better vantage point to view interior concave face 16. Graphic 17 is not able to be seen from this viewpoint.

Figure 5:
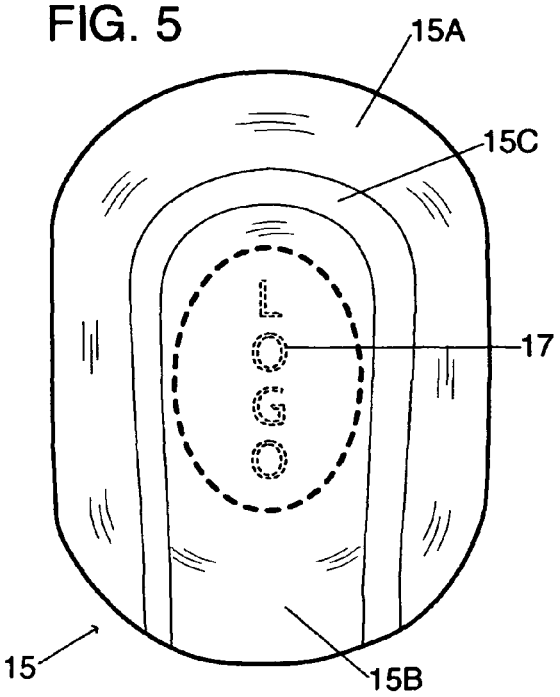
FIG. 5 shows a front view of a transparent shell that has a graphic applied to its interior face, in accordance with one embodiment.

Referring to FIG. 5, shows shell 15 in a front view and illustrates the transition from convex exterior face 15A, to concave exterior face 15B. Concave exterior face 15B being less exposed to scraping when friction occurs with cap 15 onto a ground surface. Graphic 17 is drawn in dashed lines to represent it being on the interior face 16, or the underside of the shell.

Figure 6:
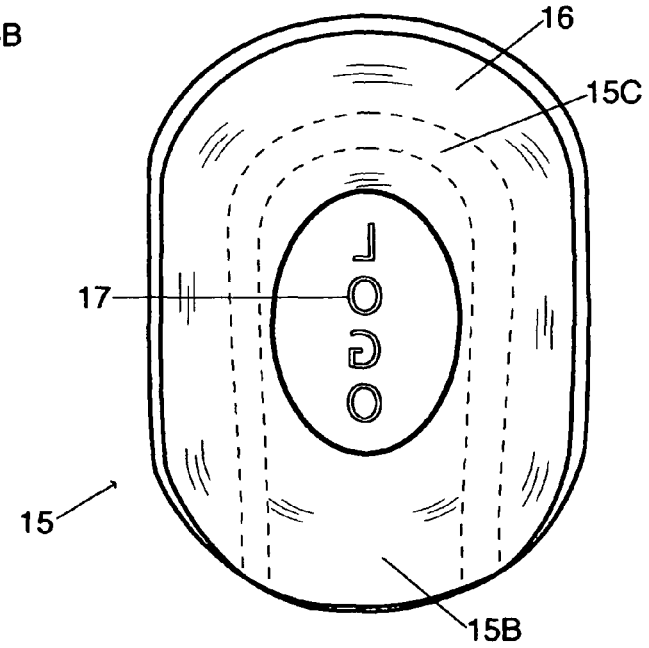
FIG. 6 shows a back view of a transparent shell that has a graphic applied to its interior face, in accordance with one embodiment.

Referring to FIG. 6, shows shell 15 with a back view. Interior concave face 16 conforms to the protection that lies underneath it. Buffer zone 15C and concave exterior face 15B are opposite of interior concave face 16 and are drawn for illustrative purposes. Buffer zone 15C is drawn in dashed lines to represent that it lies on the opposite side of interior face 16 from this viewpoint. Graphic 17 is drawn in solid lines to illustrate that it is adhered to interior concave face 16 and faces closest to the viewer.

Figure 7:
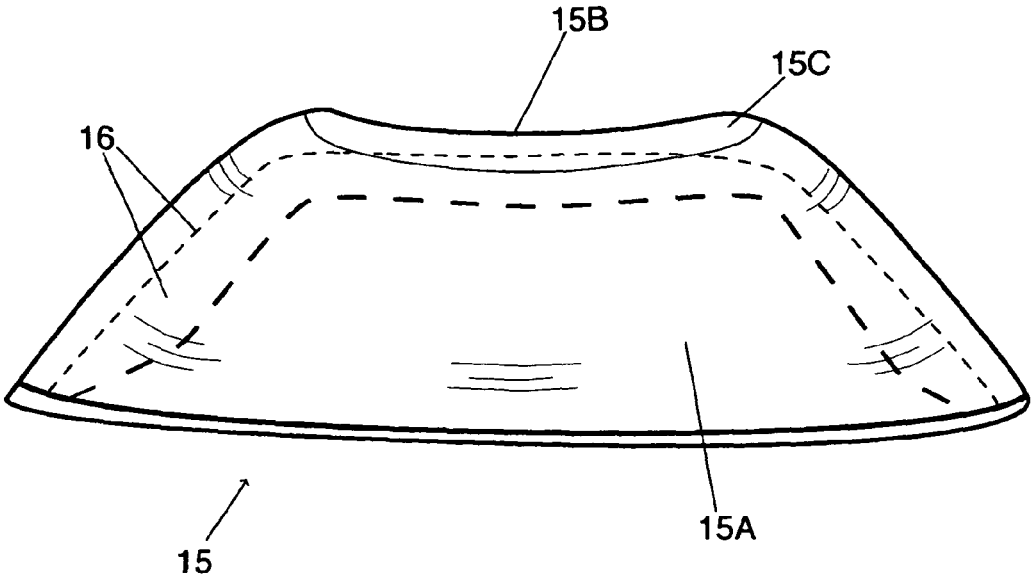
FIG. 7 shows a top view of a transparent shell that has a graphic applied to its interior face, in accordance with one embodiment.

Referring to FIG. 7, shows a top view of shell 15. This view lends itself well to show the outline of convex exterior face 15A transitioning into concave exterior face 15B and giving a better indication of how the area of concave exterior face 15B would be protected from the friction of a ground plane. Interior concave face 16 is drawn with thinner dashed lines to illustrate that it on the opposite side of exterior faces 15A, 15B, and 15C. The thicker dashed lines represent the bottom periphery of shell 15. Graphic 17 is not able to be seen from this viewpoint.

Figure 8:
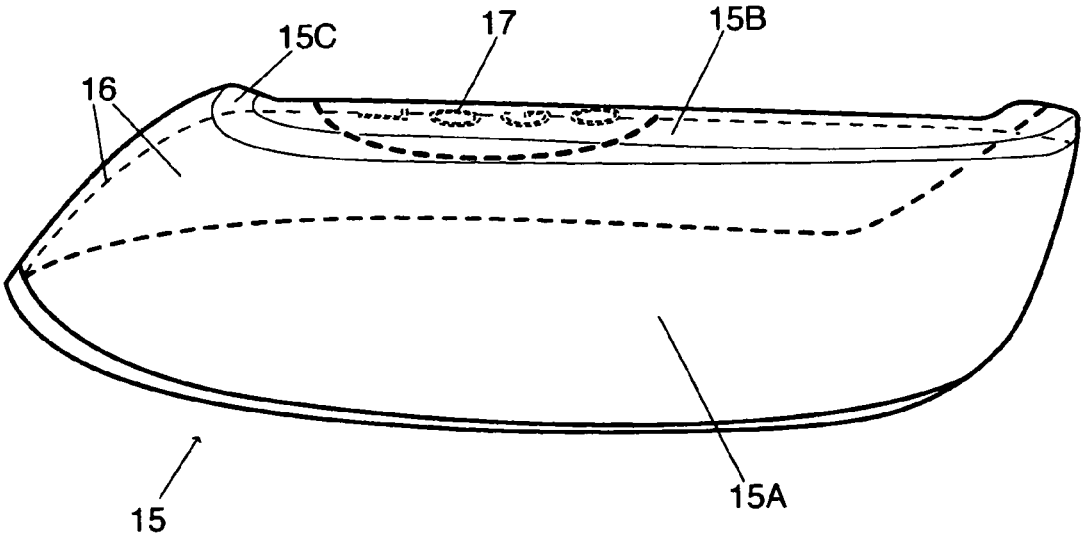
FIG. 8 shows a side view of a transparent shell that has a graphic applied to its interior face, in accordance with one embodiment.

Referring to FIG. 8, which shows shell 15 from a side view. Interior concave face 16 is shown in thinner dashed lines to represent that it is opposite of exterior faces 15A, 15B, and 15C. This view gives a better profile to view this particular shape for interior concave face 16. Graphic 17 is drawn in dashed lines to illustrate that lies underneath exterior faces 15A, 15B, and 15C, and is adhered to interior face 16. Dashed lines drawn at the bottom of shell 15 illustrate the periphery of shell 15.

Figure 9:
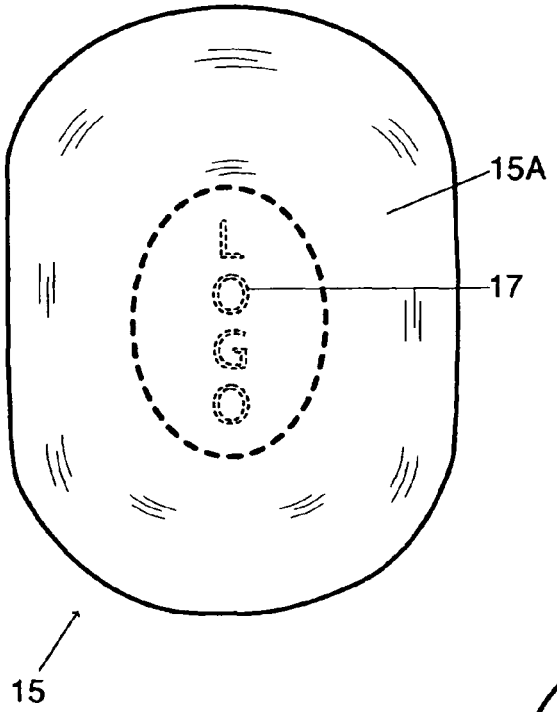
FIG. 9 shows a front view of a transparent shell that has a graphic applied to its interior face, in accordance with a second embodiment.
Figure 10:
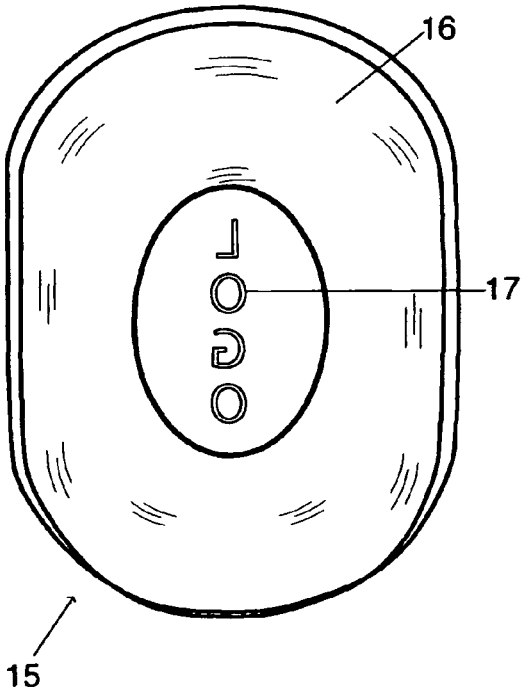
FIG. 10 shows a back view of a transparent shell that has a graphic applied to its interior face, in accordance with a second embodiment.

There are various possibilities with regard to the size, shape, and thickness of the embodiment. Referring to FIG. 9, shows one smooth convex exterior face 15A. This face mirrors the same shape as interior concave face 16 on FIG. 10. In FIG. 9, graphic 17 is drawn in dashes to illustrate that it lies under the exterior face 15A. In FIG. 10, shows graphic 17 drawn in solid lines to represent that it lies above the interior face 16 and is facing closest to the viewer.

Figure 11:
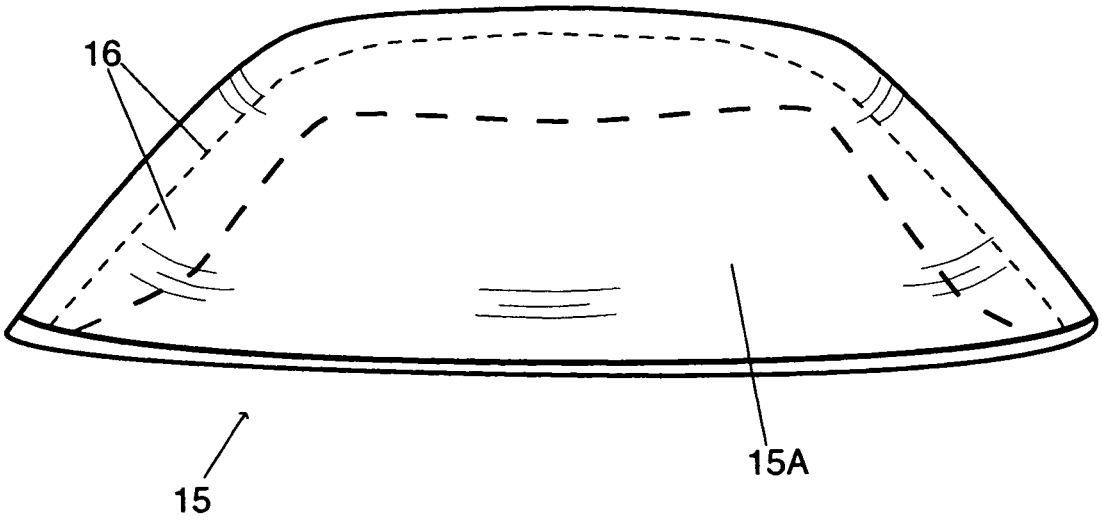
FIG. 11 shows a top view of a transparent shell that has a graphic applied to its interior face, in accordance with a second embodiment.

Referring to FIG. 11, is a top view that shows both convex exterior face 15A and interior concave face 16, both following the same general shape. Interior face 16 is drawn with thin dashes to illustrate that it is underneath exterior face 15A. Thicker drawn lines represent the periphery of the bottom of shell 15. Graphic 17 is not able to be seen from this viewpoint.

Figure 12:
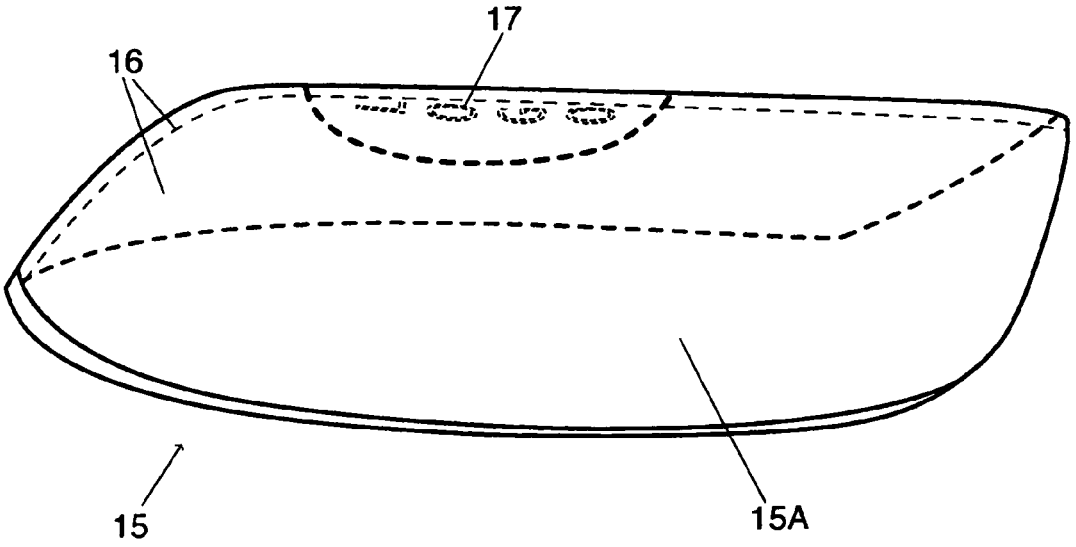
FIG. 12 shows a side view of a transparent shell that has a graphic applied to its interior face, in accordance with a second embodiment.

Referring to FIG. 12, is a side view that shows convex exterior face 15A and interior concave face 16 following the same general form. Interior face 16 is drawn in dashes to illustrate that it lies underneath exterior face 15A. Graphic 17 is drawn in dashes to illustrate that it lies underneath exterior face 15A and is adhered to interior face 16. The dashed lines at the bottom of shell 15 represents the periphery of the shell.

From the description above, a number of advantages of some embodiments of protective shell receptive for graphics become evident: Product manufacturers will have one more option to be able to place branding on their protective products through protective shells, that currently haven't been utilized. Branding or other graphics will be protected from friction with a ground plane or from collision with other objects. The elimination of the residue from a graphic onto a ground surface due to placement of the graphic on the exterior of the shell as a result of friction from the ground surface. Scuff marks upon a flooring surface will be not as apparent with transparent or semitransparent shells as opposed to colored, opaque ones.

While the above description contains many specificities, these should not be construed as limitations on the scope of any embodiment, but as exemplifications of various embodiments thereof. Many other ramifications and variations are possible within the teachings of the various embodiments. Thus, the scope should be determined by the appended claims and their legal equivalents, and not by the examples given.

I claim:

1. A protective pad, comprising:

a pad;

a shell including transparent material disposed on an exterior surface of the pad and detachable from the pad, the shell including an exterior face comprising a convex shape along a peripheral region of the shell with a transition area to a concave shape in an interior region of the shell, the shell including an interior face comprising a concave shape; and a graphic on the interior face of the shell opposite the concave shape of the exterior face and visible from the exterior face of the shell, wherein the concave shape of the exterior face creates a depression around the graphic to protect the concave shape of the exterior face from contact to maintain visibility of the graphic.

2. The protective pad of claim 1, wherein the shell includes polycarbonate.

3. The protective pad of claim 1, wherein the shell is rigid.

4. The protective pad of claim 1, wherein the graphic includes a logo.

5. The protective pad of claim 1, wherein the pad includes padded material.

6. A protective shell, comprising:

a shell including an exterior face comprising a convex shape along a peripheral region of the shell with a transition area to a concave shape in an interior region of the shell; and a graphic on an interior face of the shell opposite the concave shape of the exterior face and visible from the exterior face of the shell.

7. The protective shell of claim 6, wherein the shell includes transparent or semitransparent material.

8. The protective shell of claim 6, wherein the shell includes polycarbonate.

9. The protective shell of claim 6, wherein the interior face of the shell includes a concave shape.

10. The protective shell of claim 6, wherein the concave shape of the exterior face creates a depression around the graphic to protect the concave shape of the exterior face from contact to maintain visibility of the graphic.

11. The protective shell of claim 6, wherein the graphic includes a logo.

12. A protective shell, comprising:

a shell including an exterior face and interior face; and a graphic on the interior face of the shell visible from the exterior face of the shell.

13. The protective shell of claim 12, wherein the exterior face of the shell comprises a convex shape along a peripheral region of the shell with a transition area to a concave shape in an interior region of the shell.

14. The protective shell of claim 12, wherein the exterior face of the shell includes a convex shape.

15. The protective shell of claim 12, wherein the interior face of the shell includes a concave shape.

16. The protective shell of claim 12, wherein the shell includes transparent or semitransparent material.

17. The protective shell of claim 12, wherein the shell includes polycarbonate.

18. The protective shell of claim 12, wherein the graphic includes a logo.

19. A method of making a protective shell, comprising:

forming a shell including an interior face and exterior face comprising a convex shape along a peripheral region of the shell with a transition area to a concave shape in an interior region of the shell; and providing a graphic on the interior face of the shell opposite the concave shape of the exterior face visible from the exterior face of the shell.

20. The method of claim 19, wherein the shell includes transparent or semitransparent material.

21. The method of claim 19, wherein the shell includes polycarbonate.

22. The method of claim 19, wherein the graphic includes a logo.

* * * * *